United States Patent [19]

Gasper et al.

[11] Patent Number: 4,649,816

[45] Date of Patent: Mar. 17, 1987

[54] ELECTROMAGNETIC BEAM OR TABLE FOR SCREEN OR LIKE PRINTING

[75] Inventors: Reinhold Gasper, Klagenfurt; Peter Hassler, Maria Saal; Johannes Zimmer, Ebentaler Str. 133, 9020 Klagenfurt, all of Austria

[73] Assignee: Johannes Zimmer, Klagenfurt, Austria

[21] Appl. No.: 719,588

[22] Filed: Apr. 4, 1985

[30] Foreign Application Priority Data

Apr. 10, 1984 [AT] Austria ..... 1206/84

[51] Int. Cl.[4] ..... B41F 15/08; B41F 15/24

[52] U.S. Cl. ..... 101/126; 101/120

[58] Field of Search ..... 101/120, 126; 100/93 P; 52/490, 483, 474; 248/676, 678, 637

[56] References Cited

U.S. PATENT DOCUMENTS

Re. 20,872 10/1938 Focht ..... 52/490 X 3,998,580 12/1976 Pfiffer ..... 100/93 P X

FOREIGN PATENT DOCUMENTS 1786588 4/1974 Fed. Rep. of Germany ..... 101/120

2540136 3/1976 Fed. Rep. of Germany ..... 101/120

*Primary Examiner*—Clifford D. Crowder

*Attorney, Agent, or Firm*—Karl F. Ross; Herbert Dubno

[57] ABSTRACT

A screen-printing or roller-printing machine in which magnetic force generates the printing force against a web, has a support member, e.g. a magnet beam or worktable, which provides the attractive force for a pressure member printing the pattern on the web. The support member has limited bending resistance, i.e. can flex readily and is supported from below by a separate structure thermally insulated therefrom so that bowing of the support member does not occur.

6 Claims, 6 Drawing Figures

ELECTROMAGNETIC BEAM OR TABLE FOR SCREEN OR LIKE PRINTING

CROSS REFERENCE TO RELATED APPLICATIONS

The present application is related to the following copending applications naming as inventor or inventors, one or more of the present applicants:

U.S. Ser. No. 539,913—filed Oct. 7, 1983 (now U.S. Pat. No. 4,550,681),

U.S. Ser. No. 614,412—filed May 25, 1984 (now U.S. Pat. No. 4,557,194),

U.S. Ser. No. 614,417—filed May 25, 1984 (now U.S. Pat. No. 4,552,778),

U.S. Ser. No. 623,425—filed June 22, 1984, and

U.S. Ser. No. 658,127—filed Oct. 5, 1984.

Reference may also be had to the applications, patents and publications mentioned in the files thereof.

FIELD OF THE INVENTION

Our present invention relates to an electromagnetic beam or girder-like table structure for printing, coating and like web-processing machines and, more particularly, to such machines which employ a magnetic force for generating the pressing action.

BACKGROUND OF THE INVENTION As the aforementioned copending applications make clear, in recent years the pressure for applying a material to be deposited on a web-like substrate, e.g. a fabric or a paper sheet, has increasingly derived electromagnetic force designed to draw the pressing member against the pressing table or a beam underlying the pressing member.

Typical among such machines is a screen-printing machine in which the pattern-carrying screen is a drum which is rotatable with a peripheral speed equal to that of the substrate as it is drawn between this screen and the support table or beam, the pressing member in this case being a doctor blade or roller within the screen printing drum which processes the somewhat viscous printing medium, e.g. a fabric-printing ink or dyestuff, through the pattern on the screen to print the fabric forming the substrate.

Another application for electromagnetic force can be found in roller printing in which, for example, printing ink in a particular pattern is applied by a roller magnetically drawn against the substrate or web by a magnetic force generated by electromagnets in the underlying beam or mounted in or beneath the worktable over which the web is passed.

In the following discussion, reference to a beam or table which is provided with the electromagnetic means, will always be considered to include the other when one is specifically mentioned and both the beam and the table can be generically considered to be electromagnetic support members underlying the substrate and the pressing member which is drawn against the substrate by the electromagnetic force.

Magnetic beams and worktables, i.e. the support members mentioned above, are sensitive to bending resulting from heating, such bending being generally in the form of an upward bow toward the center of the support member.

As a result of this bending, in the central region the web is pressed with a greater amount of force against the pattern drum or printing roller while laterally outwardly of this central region, there is less pressure between the web and the support member and thus the printing pressure decreases laterally outwardly.

As a consequence, especially in screen printing, but also in the use of a printing roll to transfer an ink, because the pressing force is less in the lateral outwardmost regions and the printing medium is thereby not forced away from these regions, the print is comparatively dark whereas in the highly pressure-central region, the print is significantly lighter.

Obviously the answer to this problem is to prevent bending of the support member as much as possible, and indeed the problem has already been recognized in the art and special efforts have been taken to ensure uniform distribution of heat over the length of the beam or the width of the support member, and to brace the support member against bending.

For normal web widths and for ordinary quality standards, these efforts have been successful.

However, for relatively wide substrate widths, i.e. support beams of considerable length and worktables of substantial dimensions parallel to the axis of the printing drum or roller, and where high precision is required, i.e. the print must be of uniform darkness with considerable accuracy over the entire width of the fabric, these techniques have proved to be unsatisfactory.

Indeed, even when nonuniform temperature distributions do no develop in the support member, bending of the support member may arise. This is the case because the support member and other parts of the machine are especially sensitive to different temperatures and because the standstill temperature overnight or for weekends may differ from normal operating temperature by 40° C. and more. These fluctuations in temperature themselves give rise to bending, and naturally to the cumulative defects in the printing which have been outlined above.

OBJECTS OF THE INVENTION

It is, therefore, the principal object of the present invention to provide an improved printing or coating apparatus for the purposes described, utilizing a magnetic pressing force, whereby the drawbacks enumerated above are obviated.

Another object of this invention is to provide a printing and coating apparatus in which the uniformity of contact is maintained with high pressure over the length of the contact line or zone and thus screen or roller printing can be effected with greater precision.

Yet a further object of this invention is to improve upon the earlier printing and coating systems of the aforedescribed type so that the bending of the support member is minimized not only as to local nonuniform temperature distributions which might otherwise tend to develop in operation, but also as to the significant temperature variations which might be encountered between shutdown and operation, i.e. temperature fluctuations to which the entire machine may be subject.

SUMMARY OF THE INVENTION

These objects are attained, in accordance with the present invention, which utilizes an approach which is directly contrary to the approach used heretofore, i.e. the reinforcing of the beam or support member so that its bending resistance or stiffness is increased to minimize bending due to the thermal action mentioned previously.

We have found that it is possible to practically completely eliminate both the local effects causing beam or support member bending and the effects of temperature variation on the entire machine when the support member, i.e. the magnetic beam or the worktable, is provided so that it has a relatively reduced bending resistance or flexural stiffness and wherein the support member is engaged from below by the separate support structure of the machine which is thermally insulated at one or more points from the support member, i.e. the beam or table.

In other words, the support member of the invention is designed to bend relatively freely, i.e. need not have any significant bending resistance or flexural stiffness, provided, of course, that it has the compressive strength in the direction of magnetic force application, the beam or table being supported by a structure beneath it via thermal insulation support points or regions so that the effect of the varying temperatures on the machine structure itself are not transmitted from the support structure to the beam and conversely there is no heat conduction from the support structure to the beam or from the beam to the support structure and consequently, the temperature remains uniform in the beam without local cool or hot regions resulting from thermal conduction.

In practice the bowing of the beam is sharply reduced and in most cases completely eliminated without any other measures.

Consequently, beneath the magnetic beam or worktable at least one separate structure is provided to support the beam or the worktable and because it is thermally insulated from the beam or worktable but otherwise connected thereto, bowing of the beam is precluded.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
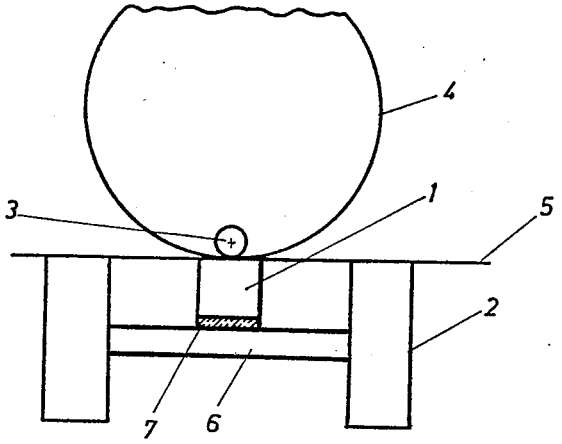
FIG. 1 is a diagrammatic end view in sectional form, illustrating the key elements of the invention.

FIG. 1 shows a magnetic beam 1 whose magnets have been illustrated in dot-dash lines at 1*a* and which draws a magnetically permeable pressing roller 3 downwardly to press the printing medium, i.e. a fabric-printing dye, through the pattern of a screen-printing drum 4 onto a substrate or web 5.

Screen-printing and roller-printing principles utilizing magnetic force are known, e.g. from the aforementioned applications, and are here used to apply the printing force over a line perpendicular to the plane of the paper at which the roller 3 and the pattern drum 4 are tangential to the plane of the upper surface of the beam 1, the web 5 being passed between the drum 4 and this beam.

Obviously instead of a pattern drum 4 and the pressing roller 3, an indirect or direct print-transfer roller can be used and can likewise be attracted by magnetic force to the beam.

The beam 1 has a relatively small cross section by comparison to its length and has little bending resistance or flexural stiffness, i.e. tends to hang down if it is supported at its ends in a catenary pattern. This type of sag can be used as a measure of the flexural stiffness or bending resistance which is desirable according to the invention.

Figure 2:
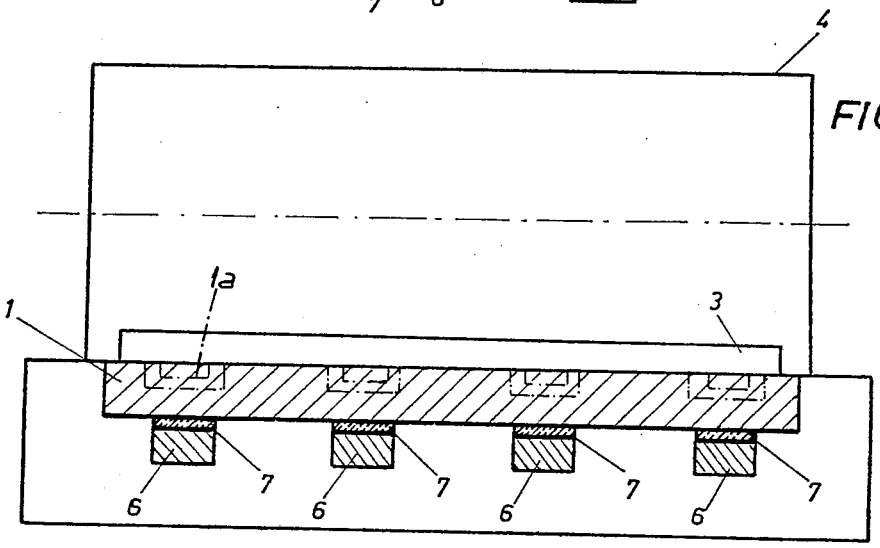
FIG. 2 is a diagrammatic axial section therethrough.

Below the magnetic beam 1, we provide a separate structure which, as can be seen from FIG. 1, is an H-form body with the cross bar of the H in the configuration of a ladder (see FIG. 2), i.e. made up of a number of spaced-apart transverse members 6 which are connected by rigid blocks of thermal insulation 7 with the underside of the magnetic beam.

Figure 5:
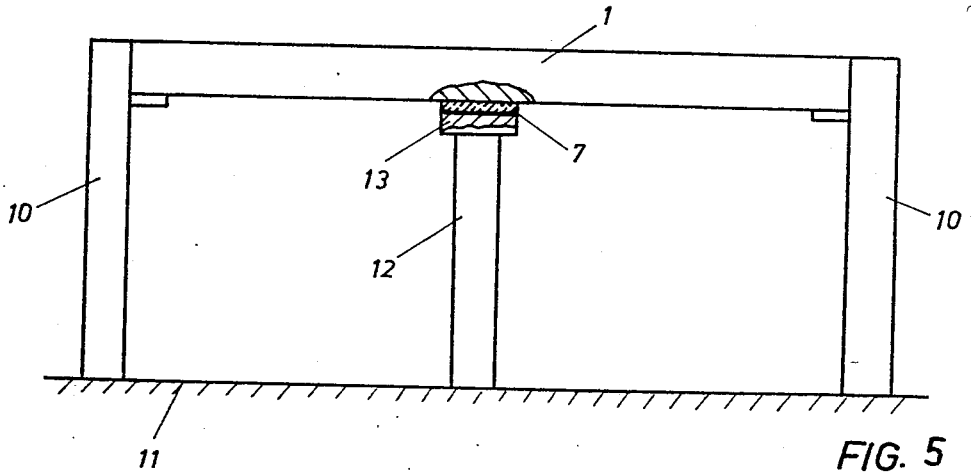
FIG. 5 is a side-elevational view showing a beam provided with a center support, the insulated region being illustrated in section.

While a number of transverse beams 6 have been illustrated in FIG. 1, it will be understood that in many cases a single bar in the middle may suffice as illustrated in principle in FIG. 5, assuming the beam is also supported by insulating braces at its ends.

Figure 3:
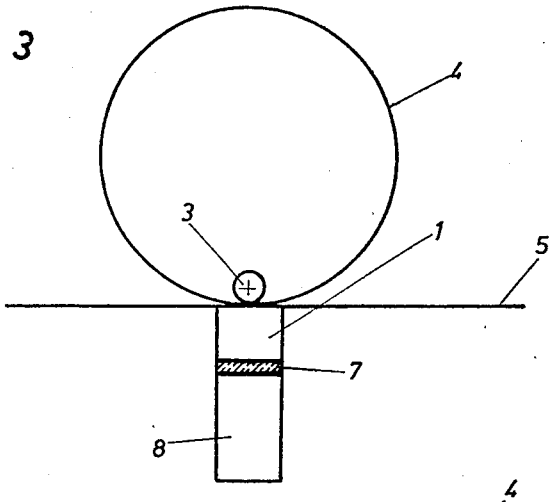
FIG. 3 is a view similar to FIG. 1 illustrating another embodiment.
Figure 4:
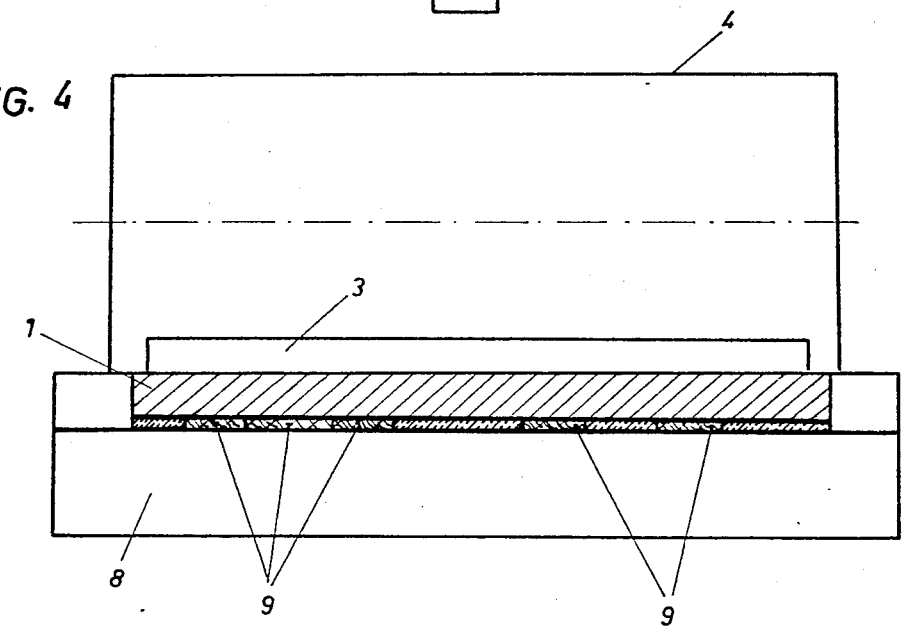
FIG. 4 is an axial section through the structure of FIG. 3, also in highly diagrammatic form.

FIGS. 3 and 4 show another embodiment in which the beam 1 is supported from below by a further beam 8 extending over the entire length of the beam 1 and carrying the force thereof through spaced-apart insulating bodies 9.

It is possible to provide thermal insulating coatings on the parts of the support structure 8, 2, 6 which contact the magnetic beam or, alternatively, to form the entire support structure as a thermal insulation body.

In the case of round or flat pattern screen-printing machines which utilize an endless support beneath the web, it is sufficient to support the magnetic beam on a support structure which lies parallel to this magnetic beam as shown in FIGS. 3 and 4 so that the framework 2 can be eliminated. When no endless underlay for the web is provided, the insulating supports can be mounted on the ground. It is also possible to make the supports vertically adjustable so as to vary the force with which the magnetic beam is supported at each point.

FIG. 5 shows a simple arrangement according to the invention in which a frame 10 carries the magnetic beam 1 and rests upon the ground or floor. In the middle of the magnetic beam 1, a single strut 12 is provided whose upper end has a head 13 which can brace against the magnetic beam via the thermal insulation layer. The strut 12 can be vertically adjustable with the vertical position being determined by a spindle with a setscrew.

Figure 6:
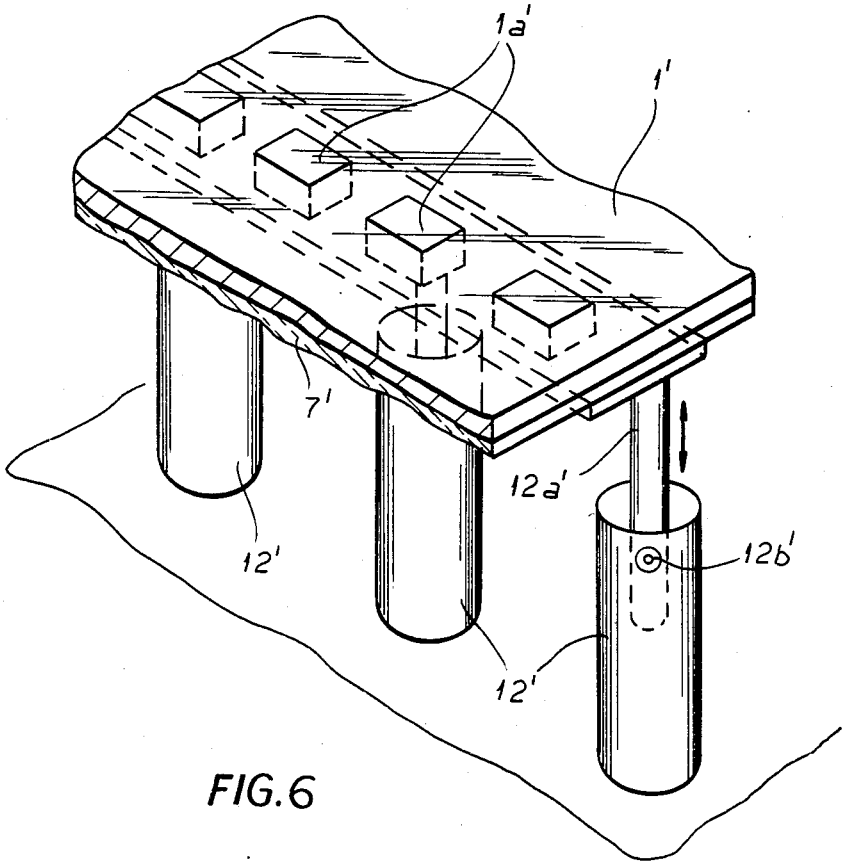
FIG. 6 is a perspective sectional view illustrating another feature of the invention.

In FIG. 6, a worktable 1′ with the magnets 1*a*′ is seen to be provided with a plurality of vertically adjustable struts 12′, the spindle being represented at 12*a*′ and the setscrew at 12*b*′. An insulating layer 7′ is provided to effect the thermal insulation in the manner previously described.

We claim:

1. In a machine for applying a medium in a pattern to a substrate web, wherein a magnetic support member extending over the width of said web attracts a pressure member against said web to effect transfer of said medium to said web, the improvement wherein said support member has spaced apart over the width of said web in a given direction a plurality of electromagnets for attracting said pressure member against said web, the cross section of said support member transverse to said direction is insufficient to resist bending of said support member, and beneath said support member at least one separate structure is provided in force transmitting relationship with said support member at a limited number of points minimizing heat transfer between said member and said structure, said support members being thermally insulated from said structure at said points.

2. The improvement defined in claim 1 wherein said structure includes at least one brace body thermally insulated from said beam but in engagement therewith and carried by supports parallel to said support member.

3. The improvement defined in claim 1 wherein said structure includes at least one bracing body resting upon the ground and in engagement with said support member while being thermally insulated therefrom.

4. The improvement defined in claim 3 wherein said bracing body is of adjustable height.

5. The improvement defined in claim 3 wherein said bracing body is disposed at the center of said member.

6. An arrangement for preventing thermal bending of long electromagnet beams or their girder-like work tables constituting a support member extending over the width of a web for pressure transfer of a dyestuff to the web with a magnetic pressing force exerted by electromagnets on said support member upon a pressure member disposed thereabove, said arrangement including below said support member, which has a cross section generally transverse to the width of the web, which is smaller than that required to prevent bending of the support member, a support structure for said support member having the smallest possible heat transfer communication with the support member while supporting it against bending at least at one support point.

* * * * *